United States Patent [19]

Hubbard

[11] 4,037,640

[45] July 26, 1977

[54] TAPESTRY HOLDER

[76] Inventor: Michael James Hubbard, 601 Hobson Ave., Hot Springs, Alaska 71901

[21] Appl. No.: 536,556

[22] Filed: Dec. 26, 1974

[51] Int. Cl.[2] ..... A47H 13/00

[52] U.S. Cl. ..... 160/398; 16/7; 38/102.91

[58] Field of Search ..... 16/16, 7, 5; 38/102.91; 160/398, 327, 328, 380, 391, 383, 371, 395, 399, 402, 403

[56] References Cited

U.S. PATENT DOCUMENTS

| | | | |
|---|---|---|---|
| 2,073,278 | 3/1937 | Hohl | 16/16 UX |
| 2,449,904 | 9/1948 | Lorraine | 16/16 UX |
| 2,496,910 | 2/1950 | Fridolph | 160/327 X |
| 3,166,117 | 1/1965 | Abodjieff | 16/5 X |

*Primary Examiner*—Andrew V. Kundrat

*Attorney, Agent, or Firm*—Stefan M. Stein; Robert F. Frijouf

[57] ABSTRACT

This tapestry holder assembly for mounting tapestry on supporting surface comprises slide bar at least one pressure plate removably engaging the slide bar so that the tapestry is clamped between the pressure plate and the slide bar, a retainer assembly for attaching assembly to the supporting structure, and slide bar stabilizer to provide support for the pressure plate.

7 Claims, 6 Drawing Figures

FIG. 1
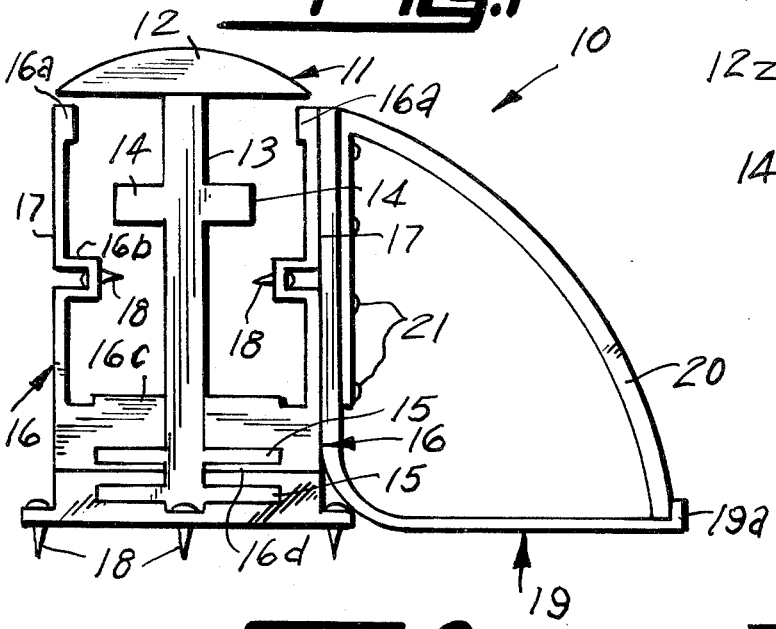
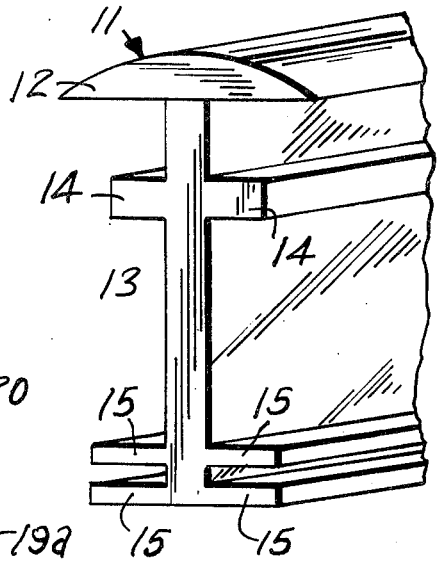
FIG. 2
FIG. 3
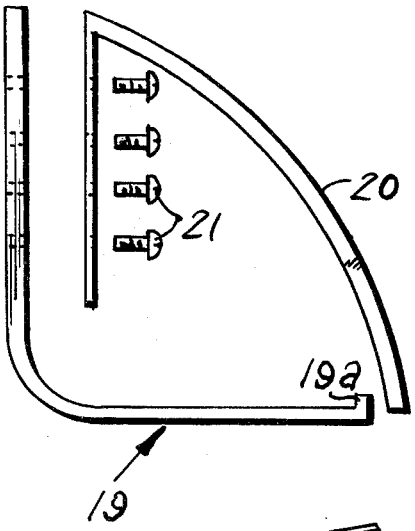
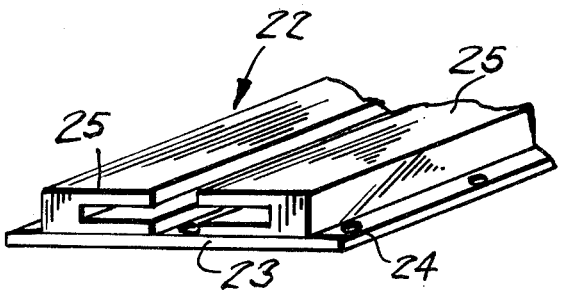
FIG. 4
FIG. 5
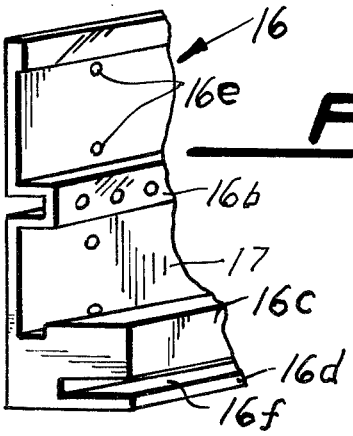
FIG. 6
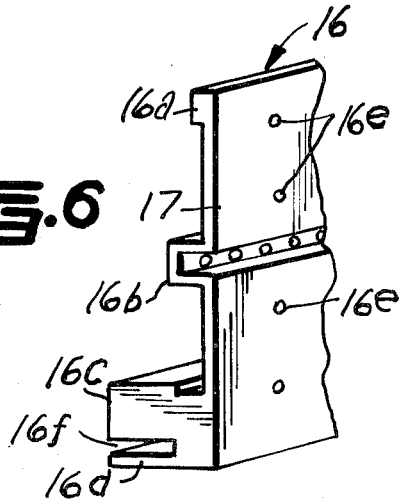

TAPESTRY HOLDER

This invention relates to securement devices for rugs and tapestry, and more particularly to a tapestry holder.

It is therefore the principal object of this invention to provide a tapestry holding assembly which will enable the mounting of a rug or tapestry on a ceiling on a spread out manner.

Another object of this invention is to provide a tapestry holder which will be of such structure, so as to render the tapestry or rug secure and the structure may be disassembled when desired.

A further object of this invention is to provide a device of the type described, which will utilize suitable fasteners for the securement of the rug or tapestry.

Other objects of the invention are to provide a tapestry holder which is simple in design, inexpensive to manufacture, rugged in construction, easy to use and efficient in operation.

These and other objects will be readily evident upon a study of the following specification and the accompanying drawing, wherein:

FIG. 1 is a side view of the present invention.

FIG. 2 is a fragmentary perspective view of the solid slide bar shown removed from FIG. 1.

FIG. 3 is a side view of the slide bar stabilizer shown exploded and removed from FIG. 1.

FIG. 4 is a fragmentary perspective view of the slide bar retainer means of the assembly shown removed from FIG. 1.

FIG. 5 is a fragmentary perspective view of the left pressure ridge slide plate of the structure.

FIG. 6 is a fragmentary perspective view of the right pressure ridge plate of the structure.

This invention relates to a tapestry holder assembly generally indicated as 10 in FIG. 1.

Referring to FIG. 2, the present invention comprises an elongated slide bar means 11 having crown portion 12 formed thereon and disposed on the upper extremity of slide bar means 11. Disposed along the longitudinal edges of the slide bar means 11 and formed thereon are three pairs of oppositely positioned and outwardly extending projections. The three pairs of projections include first pair of projection portions 14 and 14', second pair of projection portions 15 and 15' and third pair of projection portions 30 and 30'. The first projection portions 14 are disposed below crown portion 12, second projection portions 15 are disposed below the first projection portions 14, and third projection portions 30 are disposed below the second projection portions 15 and formed upon the lower extremity of the slide bar means 11.

Referring to FIGS. 5 and 6, the present invention further comprises left and right pressure plate means 16 and 16'. Right pressure plate means 16 has three protruding ridges formed therein including first protruding ridge portions 16*b*, second protruding ridge portions 16*a*, and third protruding ridge portions 16*c*. Second protruding ridge portions 16*a* are disposed in the upper extremities of the plate means 16. First protruding ridge portions 16*b* are disposed below second protruding ridge portion 16*a* and substantially in the center of the plate means 16. Third protruding ridge portion 16*c* is disposed below said first protruding ridge portion 16*d* upon the lower extremities of the plate means 16. Aperture means 16*e* are formed in the plate means 16 and are correspondingly dimensioned to receive suitable tacks 18. Groove element 16*f* is integrally formed by means of extruded channel in the third protruding ridge portion 16*c* and is configured for sliding and partially surrounding engagement of right second projection portion 15.

Left pressure plate means 16' is the mirror image of right pressure plate means 16 and as shown by FIG. 6 is correspondingly identified and labeled.

Referring to FIG. 3, the present invention further comprises slide bar stabilizer means 19 including L-shaped support member 19*a* which is locked in fixed relation to curved support member 20. In FIG. 1, slide bar stabilizer means 19 is fastened to the right pressure plate means 16 by suitable self tapping screws 21 and is disposed in resting support relation to the supporting surface. The upper end of the curved support member 20 is rigidly attached to the upper end of the L-shaped support member 19*a*. The low end of curved support member 20 is locked in fixed relation with the lower end of the L-shaped support member 19*a*.

Referring to FIG. 4, the present invention further comprises slide bar retainer means 22 including base means 23 and left and right U-shaped holder means 25 and 25' which are securely affixed to the base means 23. Channel means 32 and 32' are integrally formed by right and left U-shaped holder means 25 and 25' and are configured to slidingly engage the pair of third projection portions 30 and 30'. The base means 23 has aperture means 24 for receiving tacks 18 for tacking to a supporting wall.

By virtue of the arrangement shown in FIG. 1, the tapestry 33 is placed along the inside of right pressure plate means 16 and tacks 18 once protruding through aperture means 16*e* and embedded in the tapestry 33 causes the tapestry 33 to be securely fastened to tapestry holder assembly 10. Then the slide bar means 11 is mounted on right pressure plate means 16 by the sliding insertion of the right second projection portion 15 into right groove element 16*f*. The mounting of the slide bar means 11 provides for additional securing of the tapestry 33 in pinching the tapestry 33 by the overlapping relation of crown portion 12 with right second protruding ridge means 16*a* and the overlapping relation of right first projection portions 14 and right first protruding ridge means 16*b*. The mounting of slide bar means 11 also provides the necessary biasing to clamp the tapestry 33 against the right first protruding ridge means 16*b* so as to maintain the embodiment of the tacks 18 in the tapestry 33. The left pressure plate means 16' is then slipped over the right second projection portion 15'. The retainer means 22 is then moved in sliding relationship along slide bar means 11 by sliding insertion of the pair of third projection portions 30' and 30 into the pair of channel means 32' and 32. Finally, slide bar stabilizer means 19 is mounted as shown in FIG. 1 by means of the fasteners 21 on the right pressure plate means 16'. The slide bar stabilizer means 19 acts as a supporting brace for right pressure plate means 16. Once the tapestry 33 is mounted, it is stretched to its capacity and the slide bar 11 acts as a picture frame therefore.

The slide bar retainer means 22 can be mounted on a supporting wall or ceiling 31 either before or after slide bar means 11 has been attached to retainer means 22. Slide bar retainer means 22, both pressure plate means 16 and 16' and slide bar means 11 are all relatively elongated and of substantially equal length. If, for example, holder means 10 is to extend the entire length of a particular wall, it will be necessary for side bar retainer means 22 to be attached to slide bar means 11 before installation of retainer means 22 on the wall.

In the above recitation of how the tapestry holder 10 is used, the tapestry 33 was inserted and secured in the right side of the holder 10 between right pressure plate means 16 and the right longitudinal side of slide bar means 11. However, due to the corresponding parts of the left side of the holder 10, the tapestry 33 can also be inserted between the left pressure plate 16' and the left longitudinal side of slide bar means 11. Moreover, the slide bar stabilizer means 19 can be attached to either the left pressure plate means 16 or the right pressure plate means 16' but must be attached to the same side in which the tapestry is inserted. Once one pressure plate means 16 is used to fasten the tapestry 33, the other becomes an unnecessary element in the invention. The mounting of stabilizer means 19 on the right pressure plate 16' and the insertion of tapestry in the right side of holder 10 was shown in FIG. 1 only for clarity and was not intended to limit the scope of the present invention.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention which, as a matter of language, might be said to fall therebetween.

Now that the invention has been described, what I claim is:

1. A tapestry holder assembly for mounting a tapestry on a supporting surface comprising at least one pressure plate means, slide bar means removably engaging said pressure plate means and having an elongated configuration extending the length of said pressure plate means, said slide bar means further comprising at least one first projection portion formed thereon and disposed in outward projection toward said pressure plate means, said pressure plate means further comprising at least one first protruding ridge portion formed thereon and disposed in outward projection toward said slide bar means, said first protruding ridge portion disposed in spaced apart and substantially adjacent over-hanging relationship to said first projection portion, whereby the tapestry is clamped between said pressure plate means and said slide bar means, retainer means slidingly and removably engaging said slide bar means and attached to the supporting surface, slide bar stabilizer means attached to said pressure plate means and disposed in resting support relation to the supporting surface.

2. A tapestry holder assembly as in claim 1 wherein said slide bar stabilizer means further comprising L-shaped support member attached to said pressure plate means and disposed in resting support relation to the supporting surface and said slide bar stabilizer means further comprising a curved support member having an upper end attached to upper end of said L-shaped support member and having a lower end in locked relation with the lower end of said L-shaped support member.

3. A tapestry holder assembly for mounting a tapestry on a supporting surface comprising at least one pressure plate means, slide bar means removably engaging said pressure plate means and having an elongated configuration extending the length of said pressure plate means, said slide bar means further comprising at least one first projection portion formed thereon and disposed in outward projection toward said pressure plate means, said pressure plate means further comprising at least one first protruding ridge portion formed thereon and disposed in outward projection toward said slide bar means, said first protruding ridge portion disposed in spaced apart and substantially adjacent over-hanging relationship to said first projection portion, whereby the tapestry is clamped between said pressure plate means and said slide bar means, retainer means slidingly and removably engaging said slide bar means and attached to the supporting surface, said slide bar means further comprises crown portion formed thereon and disposed on the upper extremity of said slide bar means and above said first projection portion, said pressure plate means further comprises second protruding ridge portion disposed in the upper extremity of said pressure plate means above said first protruding ridge portion, said crown portion disposed in overlapping relation and spaced apart from said second protruding ridge portion, whereby tapestry is clamped between said second protruding ridge portion and said crown portion.

4. A tapestry holder assembly as in claim 3 wherein said slide bar means further comprises a pair of oppositely positioned first projection portions formed thereon and disposed below said crown portion, said slide bar means further comprises a pair of oppositely positioned second projection portions formed thereon and disposed below said first projection portions, said slide bar means further comprises a pair of oppositely positioned third projection portions formed thereon and disposed below said second projection portions in the lower extremity of said slide bar means, said pressure plate means further comprises a second protruding ridge portion formed thereon and disposed above said first protruding ridge portion, said pressure plate means further comprises a third protruding ridge portion formed thereon and disposed below said first protruding portion in the lower extremity of said pressure plate means, said third protruding ridge portion including a groove element integrally formed thereon and configured to removably engage and surround one of said second projection portions; said retainer means further comprising oppositely disposed channel means integrally formed therein and configured for removable and surrounding engagement of said third projection portions.

5. A tapestry holder assembly for mounting a tapestry on a supporting surface comprising at least one pressure plate means slide bar means removably engaging said pressure plate means and having an elongated configuration extending the length of said pressure plate means, said slide bar means further comprising at least one first projection portion formed thereon and disposed in outward projection toward said pressure plate means, said pressure plate means further comprising at least one first protruding ridge portion formed thereon and disposed in outward projection toward said slide bar means, said first protruding ridge portion disposed in spaced apart and substantially adjacent overhanging relationship to said first projection portion, whereby the tapestry is clamped between said pressure plate means and said slide bar means, retainer means slidingly and removably engaging said slide bar means and attached to the supporting surface, tack means mounted on said pressure plate means, pressure plate means further comprises numerous aperture means configured to receive said tack means, said tack means disposed in protruding relation with said aperture means and embedded in the tapestry, said first projection portion biasing the tapestry against said tack means, whereby the biasing of said first projection portion secures the embedment of said tack means in the tapestry.

6. A tapestry holder assembly as in claim 5 wherein said retainer means further comprises base means, aperture means formed within said base means, and tack means protruding through said aperture means.

7. A tapestry holder assembly as in claim 6 wherein second pressure plate means removably engages said slide bar means and is oppositely disposed from first pressure plate means removably engages said slide bar means and is oppositely disposed from first pressure plate means.

* * * * *